United States Patent [19]

Suzuki et al.

[11] Patent Number: 4,838,723

[45] Date of Patent: Jun. 13, 1989

[54] FLEXIBLE PEN NIB FOR WRITING PURPOSES

[75] Inventors: Churyo Suzuki, Ichikawa; Kozo Ando, Chiba; Tooru Enomoto, Tokyo, all of Japan

[73] Assignee: Aubex Corporation, Japan

[21] Appl. No.: 485,118

[22] PCT Filed: Jun. 30, 1982

[86] PCT No.: PCT/JP82/00250

§ 371 Date: Feb. 11, 1983

§ 102(e) Date: Feb. 11, 1983

[87] PCT Pub. No.: WO83/00121

PCT Pub. Date: Jan. 20, 1983

[30] Foreign Application Priority Data

Jun. 30, 1981 [JP] Japan ..... 56-101482

[51] Int. Cl.[4] ..... B43K 8/02

[52] U.S. Cl. ..... 401/199; 401/198; 401/265

[58] Field of Search ..... 401/198, 199, 292, 265

[56] References Cited

U.S. PATENT DOCUMENTS

| | | | |
|---|---|---|---|
| 3,442,739 | 5/1969 | Johnson | 401/198 X |
| 3,474,703 | 10/1969 | Davis et al. | 401/199 X |
| 3,558,392 | 1/1971 | Goodenow et al. | 156/180 |
| 3,623,941 | 11/1971 | Goodenow et al. | 401/292 X |
| 3,639,070 | 2/1972 | Davidson | 401/199 |
| 3,864,183 | 2/1975 | Hori | 156/180 |
| 3,945,869 | 3/1976 | Miller et al. | 401/198 X |
| 4,093,769 | 6/1978 | Midorikawa | 401/198 X |
| 4,104,781 | 8/1978 | Midorikawa | 401/198 X |
| 4,119,756 | 10/1978 | Midorikawa | 428/156 |

FOREIGN PATENT DOCUMENTS

| | | | |
|---|---|---|---|
| 1461585 | 12/1968 | Fed. Rep. of Germany | 401/198 |
| 43-090 | 6/1969 | Japan | 401/199 |
| 0123322 | 3/1978 | Japan | 401/198 |
| 609617 | 12/1976 | Switzerland | 401/199 |

*Primary Examiner*—Steven A. Bratlie

*Attorney, Agent, or Firm*—Renner, Otto, Boisselle & Sklar

[57] ABSTRACT

Flexible pen nib (20) for writing instruments includes a rod-like nib body having inner capillary channels (24) for passing ink therethrough. This nib body is a porous rubber-like elastic body having composite-fiber textures obtained by combining a number of longitudinally oriented crimped polyamide fibers (21), with synthetic resin elastomer (22). Those composite-fiber textures form, within the cross-section of the pen nib, random-shaped elements (23) which are arranged in a uniformly random aggregation leaving the capillary channels (24). The capillary channels (24) have an orientation in the axial direction of the pen nib, and provide the pen nib with a predetermined porosity.

5 Claims, 4 Drawing Sheets

FLEXIBLE PEN NIB FOR WRITING PURPOSES

TECHNICAL FIELD

The present invention relates to a flexible pen nib for writing instruments and, more particularly, to such a pen nib which comprises a nib body made of a bundle of fibers and formed with capillary channels for passing ink therethrough.

BACKGROUND ART

Conventionally, various improvements and proposals have been made with respect to pen nibs for writing and brush-like instruments, in an attempt to refine the writing feeling or performance. Nevertheless, each of them has shortcomings, as follows.

[A] A spearhead-like tip for writing or painting brushes is known. A spearhead-like tip includes a bundle of so-called tapered fibers, i.e. synthetic fibers each formed with a sharpened end, and provides characteristics similar to those of natural hair-made writing tips. However, since only the constituent materials in the natural hair-made tips are replaced simply by the synthetic fibers of the spearhead-like tip, those fibers have to be oriented and tied into a bundle one by one when the tips are produced, which results in a low productivity.

[B] A pen nib for marking pens and the like is known. Such nib can be produced in a relatively simple manner by uniting, by means of adhesive agent, fibers into a bundle which is then formed with a sharpened writing end. On the other hand, such a pen nib does not provide a refined writing feeling because the fibers tend to ravel at the writing end and to become napped at the outer periphery of the tip and, further, because the fibers themselves lack sufficient restoring characteristic.

[C] Another type of pen nib which is known includes a spearhead-shaped cap member formed by molding porous and spongy synthetic resin material with a fiber-made interconnecting core inserted into a bore of the cap member and fixed therein for guiding the ink flow and reinforcing the cap member. In such a pen nib the spongy material provides sufficient pliability and durability to writing pressure. On the other hand however, the tip end of the pen nib made of spongy material tends to tear off and to spring up from the writing surface due to deformation under writing pressure so that a complete contact of the pen nib with the writing surface cannot be achieved. Furthermore, the above-mentioned requirement of the interconnecting core results in complexity of construction and thus increases the number of production steps and hence the production cost of the pen nibs so that the pen nib of this type is not economical.

[D] Still another type of pen nib which is known includes a nib body with slit-like inner capillary channels, formed by extrusion-molding resilient or soft thermoplastic synthetic resin, and shaped to have a sharpened end. Such a pen nib provides an advantage that characters or letters similar to those obtained by writing brushes can be written. However, the writing touch of such a pen nib is relatively harsh, and a satisfactory ink flow characteristic cannot be obtained since the capillary channel is of slit-like structure by which a sufficient amount of ink cannot be retained within the pen point and a so-called drain-back phenomenon tends to occur.

[E] Japanese Utility Model application publication No. 38,691/80 discloses a pen nib wherein fibers are randomly entangled with each other and the surface of and the connections between the fibers are covered or united by elastic resin, such as polyamide-urethane and the like; and the thus obtained nib body is shaped to have a pointed configuration. The pen nib of such a structure has a relatively satisfactory restoring characteristic against writing pressure like the nib consisting of spongy material as mentioned in paragraph [C] above. However, such a pen nib is extremely weak in tensile and bending stresses resulting from scratchy friction by which the tip end tends to be twisted or torn off; therefore, a practically serviceable pen nib with satisfactory properties cannot be attained.

DISCLOSURE OF THE INVENTION

In order to eliminate the above-mentioned shortcomings, the inventors made extensive research on dominant factors determining writing touch or feel and characteristics with respect to physical/chemical characteristics of the structure and material. The inventors also researched production steps, conducting various experiments on the combination of various materials and molding conditions, and conceived of a pen nib which provides an extraordinary refined writing touch as well as tracing and writing performance.

The present invention aims to provide a pen nib comprising a bundle of longitudinally oriented fibers, which is formed by combining synthetic fibers and synthetic resin elastomer, both available on the market, into a specific fiber structure in the form of a rubber-like elastic body such that the writing tip has excellent flexibility, durability and wear-out resistance.

Another object of the present invention is to provide a pen nib wherein individual fibers, which are spaced from and independent of each other at the ground surface of the writing tip, have restoring characteristic to thereby prevent undesired naps.

Still another object of the present invention is to provide a pen nib which can be produced in a facilitated and economical manner by making use of known method with a reduced number of production steps.

BEST MODES FOR CARRYING OUT THE INVENTION

Figure 1:
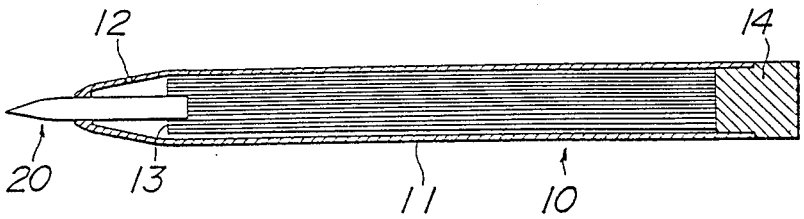
FIG. 1 is a longitudinal sectional view showing one example of a writing instrument which comprises a pen nib according to one embodiment of the present invention.

Referring initially to FIG. 1, there is shown a writing instrument 10, which may suitably be provided with a pen nib according to the present invention, and which includes a tubular main body 11 consisting of appropriate synthetic resin material. The main body 11 is formed with a vent hole 12 at the front end portion thereof on the left side in FIG. 1 and accommodates therein an ink reservoir 13 positioned by a cap 14 which closes an open rear end on the right side in FIG. 1. The pen nib 20 according to the present invention has a rear end pressedly inserted into and communicated with the reservoir 13 and a front end protruding outwardly of the main body 11 through an opening at the front end of the main body 11.

Figure 2:
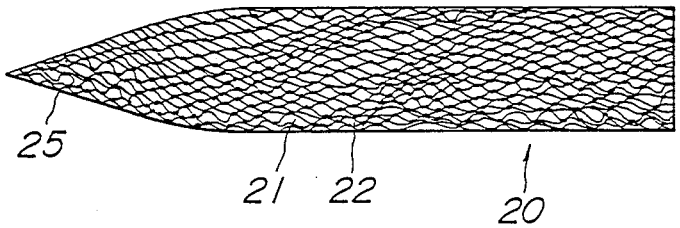
FIG. 2 is a side view of the pen nib shown in FIG. 1.
Figure 3:
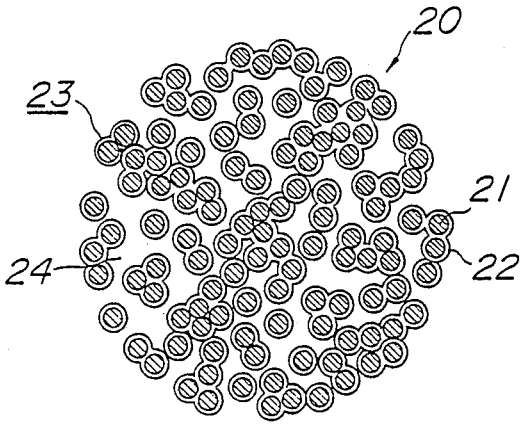
FIG. 3 is a cross sectional view, in an enlarged scale, of the pen nib shown in FIG. 1.
Figure 4:
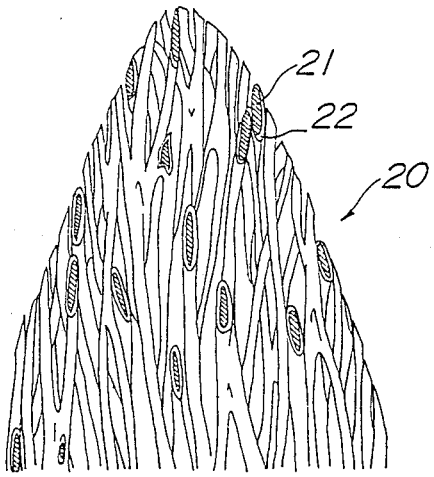
FIG. 4 is a side view, in an enlarged scale, of the writing tip of the pen nib shown in FIG. 1.

As is clearly shown in FIGS. 2 to 4, the pen nib 20 according to the present invention includes a porous rod-shaped body formed by a number of longitudinally oriented crimped polyamide fibers, each having an appropriate diameter (denier of a filament), and synthetic resin elastomer 22 to be fully described hereinafter constituting a rubber-like elastic body in the form of a composite fiber texture. The nib body 20 includes, in the cross-section thereof, random-shaped elements 23 having a composite fiber-like section formed by one or more polyamide fibers 21 as the core component and the synthetic resin elastomer 22 as the composite layer having its thickness within the range of ½ to 1/30 times, preferably 1/5 to 1/20 times the diameter of the polyamide fiber 21 (FIG. 3). Those random-shaped elements 23 are arranged into a uniformly random aggragation such that ink conducting passages consisting of a number of mutually communicating fine gaps 24 are left within the cross-section of the nib body 20. Each gap 24 extends within the interior of the nib body 20 with a longitudinal orientation, randomly varying its shape from one end to the other end of the nib body 20 in such a manner that the nib body 20 has an appropriate porosity within the range of 35 to 70%. The nib body of the above-mentioned structure is formed, for example, to have the diameter of 10 mm or less, with its one end 25 machined as a writing end, e.g. by grinding or the like.

While the synthetic resin elastomer in the above-mentioned structure can be selected from various chemical compounds, polyurethane or the like elastomers which are reaction products of isocyanate group and activated hydrogen group are particularly suitable because of excellent durability, resistance to chemical agents and wear-out resistance.

On the other hand, when considered from the aspect of physical characteristics, synthetic resin elastomers forming the composite layers with the core compositions of longitudinally oriented fibers should have well-balanced physical properties, i.e. high tensile strength and elongation. In other words, when the elongation of the synthetic resin elastomer having a high tensile strength is insufficient, application of stresses exceeding the tensile strength results in increased tendency to rupture, to encounter permanent distortion and/or to fatigue and in such case such a synthetic resin elastomer would not be appropriate. Extensive studies conducted by the inventors revealed that the synthetic resin elastomer used in the above-described specific structure should have an elongation of 200% or more and a 100% modulus of 100 kg/cm$^2$ or less, both measured in accordance with the test methods as prescribed in JIS, and preferably, an elongation of 250% or more and a 100% modulus of 20 to 60 kg/cm$^2$. It has been further revealed that the wear-out resistance of the synthetic resin elastomer is improved as the tensile strength increases above 150 kg/cm$^2$, and characteristics suitable for pen nibs can be obtained by the tensile strength of 220 kg/cm$^2$ or more.

The synthetic resin elastomer, which satisfies each of the above-mentioned conditions and cooperates with the polyamide fibers 21 to form the rubber-like elastic body in the form of composite fiber texture, may be selected from various polyurethane or the like elastomeric materials of either reactive or non-reactive thermoplastic of thermosetting type. Examples of such elastomeric materials are CORONATE/NIPPOLLAN (Nihon Polyurethane Co., Ltd.), PANDEX (Dai Nippon Ink & Chemicals Co., Ltd.), ADIPRENE L (E.I. Du Pont) and VULKOLLAN (Bayer A.G.).

Synthetic resin elastomer 22 having the above-mentioned characteristics randomly forms a composite layer extending outside and longitudinally of one or more polyamide fibers 21. Consequently, when the pen nib according to the present invention is subjected to variation in bending, torsional, compressive or tensile stress and is thereby deformed, elastic distortion energy is generated on the interface between the synthetic resin elastomer 22 and the core formed by the polyamide fibers 21, functioning as the reaction force, so that an excellent restoring characteristic against deformation is obtained. This means that the writing end 25 of the pen nib 20 normally extends in parallel with longitudinal axis of the composite fibers and has such a flexibility that, upon writing, it rapidly deforms and restores in response to variation in the writing pressure, writing angle and writing direction, well maintaining the contact with the writing surface; and, thus, flexibility is obtained.

The touch of the pen nib 20 having the abovementioned structure varies over a wide range in accordance with the kind, denier and extent of the crimps of the fiber 21 forming the core and the porosity of the nib body. In the present invention, the fibers 21 consist of polyamide since, like animal fibers, amide connections are included in the molecular structure, affording a relatively high hygroscopicity or capillarity when compared with other synthetic fibers, by which absorbed moisture causes the fiber to swell thereby lowering the rigidity, and since the polyamide has also an excellent wear-out characteristic. When fibers are united into a specific composite structure having a longitudinal orientation, the rigidity in general tends to increase depending upon the additional composite factors. Such a tendency is particularly distinct in the fiber structures which is poor in capillarity resulting in difficulties in lowering the rigidity. Accordingly, the above-described various characteristics of the polyamide fibers are particularly important in providing the composite fiber structure with excellent flexibility and resiliency.

Furthermore, even in the case of polyamide fibers, the rigidity becomes higher as the denier increases so that the writing end 25 at its ground surface tends to become napped when swelled by absorbing moisture or when the writing is completed. Although the boundary is still not clear, experiments conducted by the inventors revealed that, by making the filament denier smaller within the range of 7 deniers or less, without varying as far as possible the other component factors, an optimum pliant deformation-response characteristic can be obtained with respect to variation in the stress applied to the writing end, and that undesired naps can be avoided.

The crimps applied to the fibers also contribute effectively to the deformation response characteristic at the writing end 25. More specifically, not only are the twining of the fibers and the formation of the gaps within the pen nib 20 enhanced by the crimps but also, a certain degree of freedom of deformation can be applied to the composite fiber structure under the predetermined aggregation state so that the deformation-response characteristic of the writing end is improved.

Moreover, as the porosity of the pen nib becomes smaller, the ink flow rate decreases weakening the trace also, free flowing movement of the composite fiber texture is reduced and similarly results in a lowering of the local or overall degree of freedom of deformation at the writing end under variation in the writing pressure. On the other hand, as the porosity of the pen nib becomes excessively higher, each fiber tends to separate from the other at the writing end 25. Experiments conducted by the inventors revealed that, in order to obtain pen nibs having desired touch and writing characteristics, the porosity should preferably be within the range of 35 to 70% and, more suitably, within the range of 40 to 60% when the production conditions and assembly steps are also taken into considerations.

Figure 5:
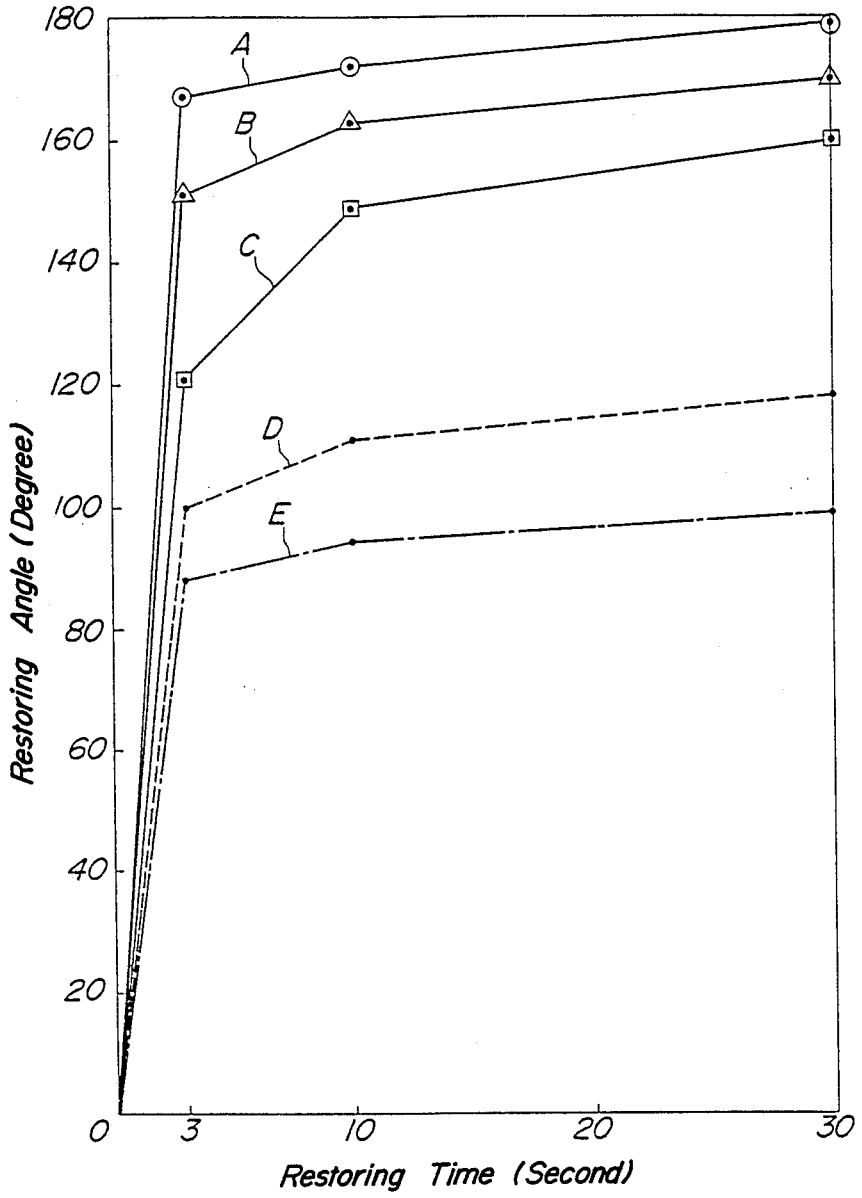
FIG. 5 is a graph showing the flexing-restoring characterisitc of pen nibs according to the present invention.

The pen nib according to the present invention has an excellent restoring characteristic against deformation, as shown in FIG. 5. The graph in FIG. 5 shows the relation between the restoring angle and the required restoring time of various pen nibs each having a length of 70 mm and being unloaded after being maintained for 30 seconds in a condition in which it is bent 180 degrees. Curve A in FIG. 5 shows the restoring characteristic of a pen nib according to the present invention have a porosity of 48%; curve B shows the restoring characteristic of a pen nib according to the present invention having a thickness of the synthetic resin elastomer increased over that in the pen nib of the curve A and a porosity of 43%; and curve C shows the restoring characteristic of a pen nib according to the present invention with the amount of core fibers increased by 20% and the thickness of the synthetic resin elastomer reduced such that the porosity become 44%. On the other hand, curve D shows the restoring characteristic of a conventional pen nib consisting of polyamide fibers and polyurethane resin and having a porosity of approximately 45%, and curve E shows the restoring characteristic of another conventional fiber bundle pen nib which uses polyester fibers.

The pen nib 20 of the above-mentioned structure according to the present invention has a markedly excellent flexibility which is obtained by the longitudinally oriented fine fibers 21 having pliability and improved deformation-response to externally applied force, and, cooperating therewith, by the synthetic resin elastomer 22 having a sufficient elasticity and restoring characteristic. Further, as the pen nib is formed with ink passages 24 therein having a longitudinal orientation and consists of a porous structure with an adequate porosity that a large amount of ink can be absorbed and retained, the ink flow characteristic has a sufficient followability to the variation in the writing speed and the width of the trace. Since the individual composite-fiber structure of the present invention has an excellent restoring characteristic and wear-out resistance, even when some of the structures ravel at the writing end 25, those structures are restored into their predetermined shape without any difficulities. As the result, the pen nib according to the present invention provides excellent writing touch and writing characteristics which can be compared with those of tips for conventional writing or painting brushes and, by making use of its flexibility, the pen nib can be utilized in wide variety of fields, such as calligraphy and paintings.

The pen nib according to the present invention can be produced easily and, economically at high productivity, for examle by known continuous molding processes described e.g. in U.S. Pat. Nos. 3,864,183 and 3,558,392; the production steps also may include cutting the molded article into nib bodies of desired length, applying after-curring to the nib bodies, if necessary, and grinding one end of the nib bodies. Further, as is shown in FIG. 1, the present invention also provides a remarkable economic advantage that the assembly has a very simple structure.

Figure 6:
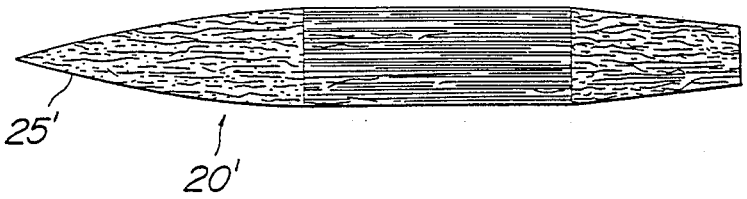
FIGS. 6 and 7 are side views of pen nibs according to other embodiments of the present invention.
Figure 7:
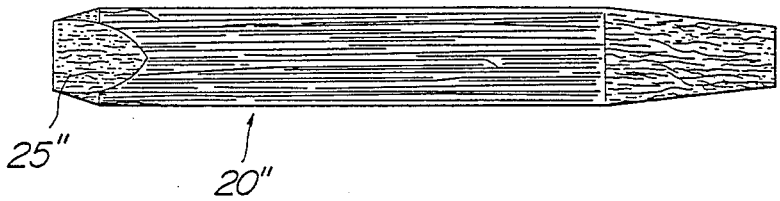

FIG. 6 shows a pen nib 20' having its writing end 25' formed into a shape similar to that of the writing brush, which is suitable for writing calligraphic letters. FIG. 7 shows a pen nib 20'' having its writing end 25'' formed into a chisel-shape, which is suitable for calligraphic arts. In both of those embodiments, rear ends of the pen nibs on right sides of the FIGS. are ground into frusto-conical shape such that they communicate with the reservoir with a greater surface area.

We claim:

1. A pen nib for writing instruments, comprising a nib body made of a bundle of fibers and formed with capillary channels for passing ink therethrough:

said nib body (20) being a porous rod-like body including a number of longitudinally oriented crimped polyamide fibers (21), and synthetic resin elastomer (22) having an elongation of approximately 200% or more, and a 100% modulus of approximately 100 kg/cm$^2$ or less, said synthetic resin elastomer (22) cooperating with the polyamide fibers to form a rubber like elastic body in the form of a composite-fiber textures; said synthetic resin elastomer (22) having one or more of said polyamide fibers (21) as the core, to form random-shaped elements (23) having composite fiber-like sections, the random shaped elements being arranged in a randon aggregation in any cross-section of the nib body (20), leaving said capillary channels in the form of a number of fine gaps (24);

said gaps (24) having an orientation in the axial direction of the nib body (20) and, inside of the nib body (20), a porosity within a range of 35 to 70%; at least one end of the nib body (20) being formed as a writing end (25) having an elastic restoring characteristic provided by the synthetic resin elastomer (22) extending longitudinally of the polyamide fibers (21) of the random-shaped elements (23).

2. The pen nib as claimed in claim 1, wherein each of said polyamide (21) fibers has its diameter of 7 deniers or less.

3. The pen point as claimed in claim 1, wherein said synthetic resin elastomer (22) consists of polyurethane which is a reaction product of isocyanate group and activated hydrogen group.

4. The pen nib as claimed in claim 1, wherein said writing end (25) has a sharpened configuration.

5. The pen point as claimed in claim 1, wherein said writing end (25) has a chisel-like configuration.

* * * * *